United States Patent [19]

Lehrman

[11] 4,384,533

[45] May 24, 1983

[54] ADJUSTABLE HEIGHT IRONING BOARD

[75] Inventor: David Lehrman, Cheltenham, Pa.

[73] Assignee: Ironees Company, Philadelphia, Pa.

[21] Appl. No.: 224,592

[22] Filed: Jan. 12, 1981

[51] Int. Cl.[3] ..... A47B 3/02

[52] U.S. Cl. ..... 108/117; 38/DIG. 2; 108/145; 108/146

[58] Field of Search ..... 108/116, 117, 145, 146; 38/DIG. 3, DIG. 2, DIG. 1, 103; 297/26; 292/269

[56] References Cited

U.S. PATENT DOCUMENTS

| | | | |
|---|---|---|---|
| 200,291 | 2/1878 | Hart | 108/117 |
| 369,856 | 9/1887 | Hulet | 108/116 |
| 1,977,050 | 10/1934 | Ellis | 108/116 |
| 2,663,102 | 12/1953 | Olander | 38/DIG. 2 |
| 2,709,818 | 6/1955 | Freese | 108/146 X |
| 2,873,543 | 2/1959 | Lantz | 108/117 |
| 3,018,574 | 1/1962 | Munson et al. | 108/117 |

FOREIGN PATENT DOCUMENTS

| | | | |
|---|---|---|---|
| 803931 | 4/1951 | Fed. Rep. of Germany | 297/26 |
| 1123709 | 6/1956 | France | 108/116 |
| 1257767 | 2/1961 | France | 108/116 |
| 1360588 | 6/1963 | France . | |
| 982538 | 2/1965 | United Kingdom | 108/117 |

*Primary Examiner*—James T. McCall

*Attorney, Agent, or Firm*—Seidel, Gonda, Goldhammer & Panitch

[57] ABSTRACT

An ironing board has adjustable legs providing a multiplicity of heights of the ironing surface to suit the height of the ironer. The ironing board is compact and may be folded flat for easy storage in confined spaces.

6 Claims, 6 Drawing Figures

ADJUSTABLE HEIGHT IRONING BOARD

BACKGROUND OF THE INVENTION

Clothes ironing is generally done on ironing boards of wood or metal, usually with standard surface dimensions of approximately 54 inches by 15 inches and in the general form of a rectangle with a tapered "nose" at one end. Folding legs are usually provided, sometimes permitting adjustment for a multiplicity of heights to suit the ironer.

With the advent of permanent press fabrics, traditional habits of ironing have been changing to occasional "touch-up" ironing. To accommodate this style of convenience ironing, at any time, in any room, consumers have turned to compact, miniature ironing boards which can be transported easily within the home for use on any working surface, and which can be stored easily in closets, drawers, or in suitcases when traveling. These miniature ironing boards vary in dimensions, but are generally about half the size of standard ironing boards. Since these miniature ironing boards are typically used on table tops and the like, it is customary to provide only short fixed legs up to about 6 inches in length to support the ironing board. In some cases, the legs can be folded.

Unlike standard ironing boards, these miniature ironing boards have without exception failed to provide any height adjustments whatsoever to suit the height of the ironer in relation to the height of the working surface on which the miniature ironing board is placed.

SUMMARY OF THE INVENTION

The present invention is an ironing board which may be adjusted to a plurality of different heights. The ironing board has a pair of legs pivoted in the center. One of the legs is mounted pivotably at one end of the underside of the ironing board. The second leg is connected to the opposite end of the ironing board by a latch assembly which permits the second leg to be fixed at different points on the underside of the ironing board, thus providing for a number of different heights. The latch assembly includes a latch plate having a longitudinal slot and a number of transverse slots which communicate with the longitudinal slot. The latch is slideable within the slots and may be locked in position by means of notches at the ends of the transverse slots. The latch assembly also provides for an extreme leg position so that the legs may be folded flat for storage. Height adjustments are made manually by releasing the latch and moving the legs to the desired height, and then engaging the latch to lock the legs in position.

It is an object of this invention to provide a miniature ironing board with adjustable heights which may be selected by the ironer to suit the height of the ironer in relation to the height of the working surface.

Other objects and advantages of this invention will appear hereinafter.

DETAILED DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
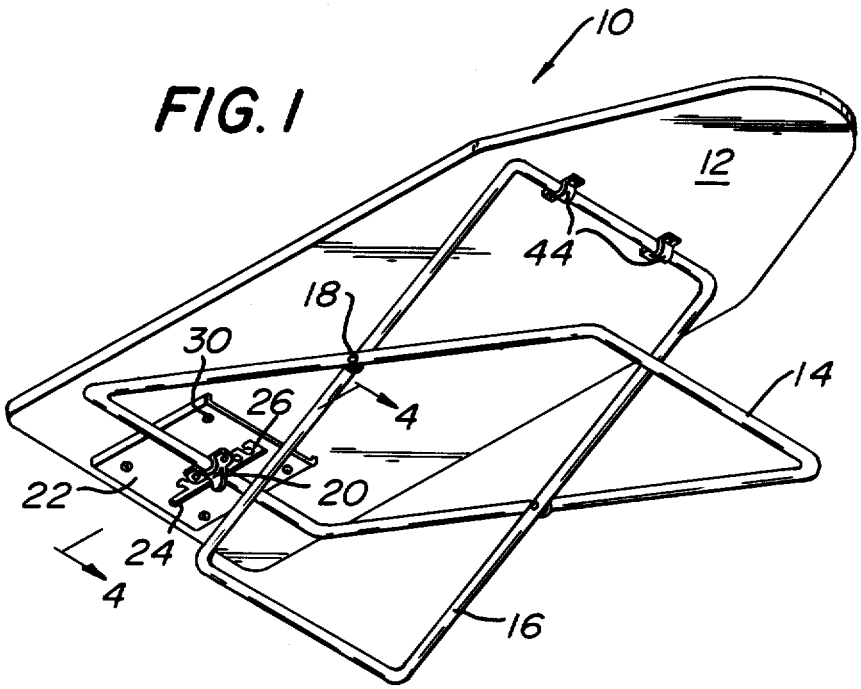
FIG. 1 is a perspective view of the invention.

Referring to the drawings, wherein like numerals indicate like elements, there is shown in FIG. 1 an embodiment of the present invention, generally indicated by 10. The ironing board comprises an ironing surface 12 to the underside of which are attached two legs 14 and 16, as described more fully hereinafter. Legs 14 and 16 are pivotably joined at their centers by pin 18. The legs in the embodiment illustrated are in the form of rectangles with rounded corners and are made in one piece from tubular metal or plastic. However, the legs may be of any suitable configuration without departing from the spirit of the invention. By way of example and not of limitation, the legs may be I-shaped.

Figure 2:
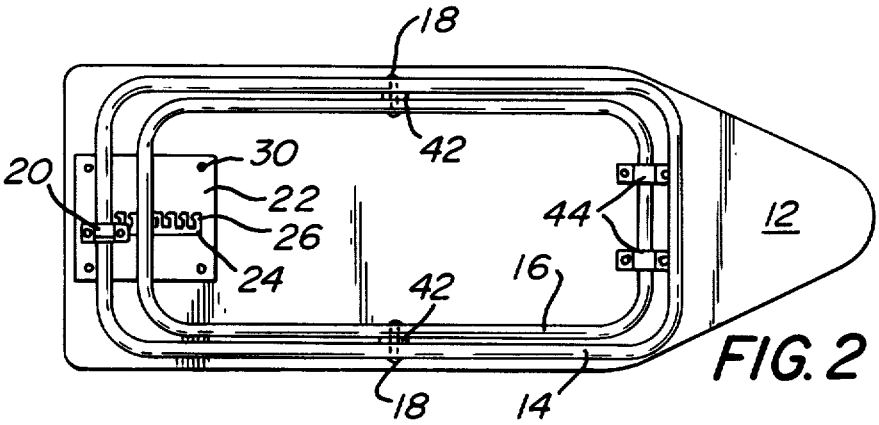
FIG. 2 is a bottom view of the invention showing the legs in a folded position and showing the latch.

As shown more clearly in FIG. 2, leg 16 is mounted to the underside of the forward end of board 12 by brackets 44. Leg 16 is free to pivot about brackets 44. As noted above, leg 16 is connected to leg 14 at approximately their mutual centers by means of pin 18 and spacer 42. The dimensions of leg 16 are less than the dimensions of leg 14. This enables leg 16 to fit inside of leg 14 in a "nesting" fashion, so that the legs may be folded flat for easy storage. A latch plate 22 is mounted on the underside of board 12 in the center of the rear portion thereof. As shown more clearly in FIG. 4, latch plate 22 is formed from a single piece of metal or plastic, and has a bottom wall 50 and side walls 46 and 48. The height of side walls 46 and 48 is such that sufficient clearance d is provided between the underside of board 12 and rivets 36 and 38. Clearance d may be any distance as long as sufficient clearance is provided for the movement of rivets 36 and 38 in the slots in the latch plate. Latch plate 22 is mounted to the underside of board 12 by means of screws 30. Alternatively, the latch plate 22 may be mounted to the underside of board 12 using conventional mounting techniques without departing from the invention.

Figure 3:
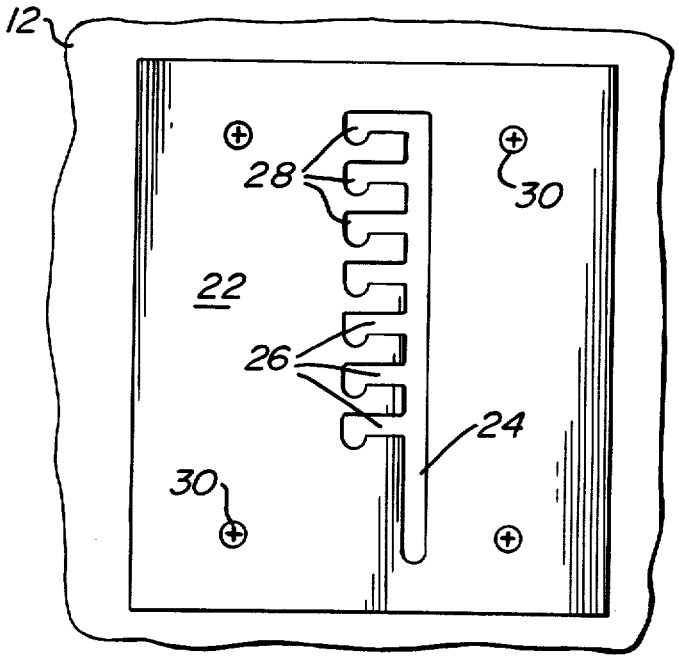
FIG. 3 is a detail of the latch plate.

As shown in FIGS. 2 and 3, latch plate 22 is provided with a slot arrangement consisting of longitudinal slot 24 and a plurality of transverse slots 26 which communicate at one end with longitudinal slot 24. The ends of transverse slots 26 remote from longitudinal slot 24 are provided with rounded notches 28. The dimensions of the rounded notches 28 conform to the diameter of rivets 36 and 38 in the sliding latch 20. Latch 20 may be moved longitudinally within slot 24 or transversely within slots 26. Latch 20 may be locked in place in any of the transverse slots 26 by engaging the rivets 36 and 38 with notches 28. Notches 28 are directed toward the rear of the ironing board 10 so that pressure upon the ironing surface forces latch 20 into notches 28, positively locking the ironing board 10 into position. It should be noted that, although rounded notches are employed in the embodiment described, the notches may be rectangular or any other shape without departing from the invention.

Figure 4:
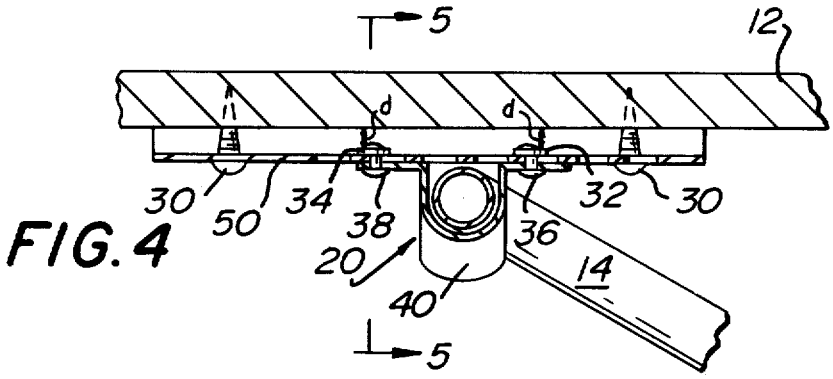
FIG. 4 is a section taken through line 4—4 of FIG. 1.
Figure 5:
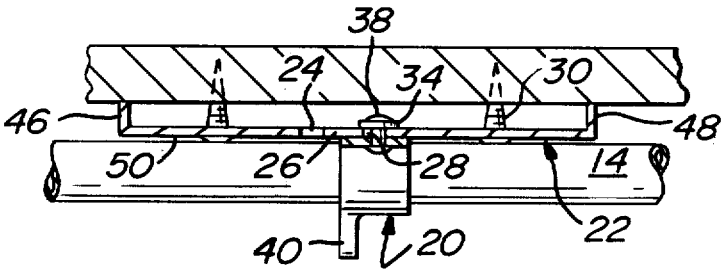
FIG. 5 is a section taken through line 5—5 of FIG. 4.
Figure 6:
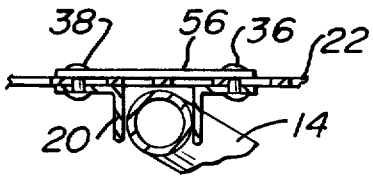
FIG. 6 illustrates a variation of the latch assembly.

As shown in FIGS. 2, 4 and 5, latch 20 serves to movably mount one end of leg 14 to the latch plate 22. Latch 20 is provided with a handle 40 to facilitate manipulation of the latch. Latch 20 is slideably mounted in the slot arrangement of latch plate 22 by means of rivets 36 and 38 and spacers 32 and 34. The mounting means is not limited, however, to the use of two spacers 32 and 34. For example, the latch 20 may also be mounted to latch plate 22 by means of rivets 36 and 38 and a single spacer 56 as shown in FIG. 6.

It is anticipated that latch 20 can be slideably mounted to latch plate 22 using only a single rivet instead of two rivets without departing from the invention. However, the second rivet eliminates the possibility of any transverse movement of the latch 20 which would cause the ironing board 10 to be unstable.

In use, the height of the ironing board 10 is adjusted by manually grasping the handle 40 of latch 20 and sliding latch 20 in longitudinal slot 24 until the desired height of the ironing board 10 is reached. Latch 20 is then moved transversely in slots 26 and locked into position by engaging rivets 36 and 38 into the notches 28 in transverse slots 26.

It will be appreciated that any number of heights and incremental spacings between different heights may be achieved by varying the number and incremental spacing of transverse slots 26. Thus, ironing board 10 can be virtually continuously adjustable from minimum height (i.e., folded position) to maximum height.

The ironing board 10 has a preferred length of 32 inches and a preferred width of 12 inches so as to be a so-called miniature ironing board for use on tops of tables, counters, beds, etc. The ironing board 10 also has a preferred thickness of ½ inch when folded flat so as to be easily storable in closets, drawers or suitcases.

The present invention may be embodied in other specific forms without departing from the spirit or essential attributes thereof and, accordingly, reference should be made to the appended claims, rather than the foregoing specification, as indicating the scope of the invention.

I claim:

1. An adjustable height ironing board comprising:

(a) an ironing board, (b) a pair of legs pivotably connected at a point intermediate their ends, the first leg being pivotably mounted at one end thereof to the underside of said ironing board at one end thereof, (c) a latch plate mounted at the other end of the underside of said ironing board and having a longitudinal slot and a plurality of transverse slots communicating at one end thereof with said longitudinal slot, each of said transverse slots having a notch at the end thereof remote from said longitudinal slot, and (d) a latch means slideably mounted on the second leg and being movably mounted on said latch plate so as to be slideable within said longitudinal slot and said transverse slots and engageable with said notches at the ends of said transverse slots.

2. Apparatus as in claim 1 wherein said legs are tubular metal and are in the shape of a closed rectangle having rounded corners.

3. Apparatus as in claim 1 wherein said latch plate is a single piece of metal and comprises a bottom wall containing said longitudinal and transverse slots, and two transversely opposed side walls.

4. Apparatus as in claim 3 wherein each of said side walls terminates in an outwardly directed tab perpendicular to said side wall and extending the length of said side wall.

5. Apparatus as in claim 1 wherein said latch means is constructed from a single piece of metal and includes a handle.

6. An adjustable height ironing board comprising:

(a) an ironing board, (b) a pair of legs pivotably connected at a point intermediate their ends, said legs being tubular metal and in the shape of a closed rectangle having rounded corners, the first leg being pivotably mounted at one end thereof to the underside of said ironing board at the forward end thereof, (c) a latch plate mounted to the underside of said ironing board at the rear end thereof, said latch plate being a single piece of metal and having a bottom wall and two transversely opposed side walls, each of said side walls terminating in an outwardly directed tab perpendicular to said side wall and extending the length of said side wall, said latch plate bottom wall having a longitudinal slot and a plurality of transverse slots communicating at one end thereof with said longitudinal slot, each of said transverse slots having a rounded notch at the end thereof remote from said longitudinal slot, and (d) a latch means slideably mounted on the second leg and being movably mounted on said latch plate so as to be slideable within said longitudinal slot and said transverse slot and engageable with said rounded indentures at the ends of said transverse slots.

* * * * *